US011618148B2

(12) United States Patent
Weinberger et al.

(10) Patent No.: US 11,618,148 B2
(45) Date of Patent: Apr. 4, 2023

(54) MULTI-TOOL APPARATUS AND METHODS

(71) Applicant: MIW Associates LLC, Havertown, PA (US)

(72) Inventors: Marvin Weinberger, Havertown, PA (US); Adam Michael Hecht, Wyckoff, NJ (US); Ryan Langeveld, Jackson, NJ (US)

(73) Assignee: MIW Associates LLC, Havertown, PA (US)

( * ) Notice: Subject to any disclaimer, the term of this patent is extended or adjusted under 35 U.S.C. 154(b) by 462 days.

(21) Appl. No.: 15/964,711

(22) Filed: Apr. 27, 2018

(65) Prior Publication Data

US 2018/0311804 A1 Nov. 1, 2018

Related U.S. Application Data

(60) Provisional application No. 62/490,809, filed on Apr. 27, 2017.

(51) Int. Cl.

| | |
|---|---|
| ***B25F 1/04*** | (2006.01) |
| ***B25F 1/00*** | (2006.01) |
| ***B26B 11/00*** | (2006.01) |
| ***B25B 13/56*** | (2006.01) |
| ***B25F 1/02*** | (2006.01) |
| ***B25G 1/08*** | (2006.01) |

(52) U.S. Cl.

CPC ..... *B25F 1/04* (2013.01); *B25B 13/56* (2013.01); *B25F 1/003* (2013.01); *B25F 1/02* (2013.01); *B25G 1/08* (2013.01); *B26B 11/00* (2013.01)

(58) Field of Classification Search

CPC .... B25F 1/04; B25F 1/003; B25F 1/02; B25B 13/56; B25G 1/08

USPC ..... 7/168

See application file for complete search history.

(56) References Cited

U.S. PATENT DOCUMENTS

| | | | | |
|---|---|---|---|---|
| 564,625 | A * | 7/1896 | Kelsea | B25B 13/08 81/119 |
| D137,916 | S * | 5/1944 | Mrazek | D22/118 |
| 3,839,788 | A * | 10/1974 | Addis | B26B 29/02 30/287 |
| 5,669,273 | A * | 9/1997 | Huang | B25B 15/00 81/438 |
| 6,286,397 | B1 * | 9/2001 | Taggart | B25F 1/04 81/177.4 |
| 6,318,218 | B1 * | 11/2001 | Anderson | B25F 1/003 81/440 |

(Continued)

OTHER PUBLICATIONS

Webpage of Levergear.com, entitled, "Introducing the Lever Gear Toolcard™", Retrieved from the Internet on Apr. 27, 2018, via the Wayback Machine as captured Apr. 15, 2017, at URL: « http://web.archive.org/web/20170415215744/https://levergear.com/ », 11 pages.

*Primary Examiner* — Hadi Shakeri

(74) *Attorney, Agent, or Firm* — Duane Morris LLP

(57) ABSTRACT

A multi-tool includes a body having a top face and a bottom face. At least one opening extends from the top face to the bottom face. The at least one opening is sized and configured to receive a finger of a user. A perimeter face connects the top face and the bottom face. The perimeter face includes a convex portion spaced from the at least one opening in a first direction. The convex portion is configured to contact a palm of the user. The body also includes two or more tools formed in the body.

18 Claims, 11 Drawing Sheets

(56) References Cited

U.S. PATENT DOCUMENTS

| | | | | |
|---|---|---|---|---|
| D509,353 | S * | 9/2005 | Billings | D3/211 |
| 8,069,570 | B2 * | 12/2011 | Taylor | B25F 1/00 30/143 |
| 8,713,735 | B1 * | 5/2014 | Pelton | B67B 7/44 7/138 |
| 9,126,324 | B2 * | 9/2015 | Hunkele | B25G 1/102 |
| D755,593 | S * | 5/2016 | Henderson | D8/21 |
| 9,815,212 | B2 * | 11/2017 | Barr | A45D 24/08 |
| 10,265,874 | B1 * | 4/2019 | Morgan | B25F 1/04 |

* cited by examiner

MULTI-TOOL APPARATUS AND METHODS

CROSS-REFERENCE TO RELATED APPLICATIONS

This application claims priority to U.S. Provisional Application No. 62/490,809, filed Apr. 27, 2017, the entirety of which is incorporated herein by reference.

FIELD

The present disclosure is directed to a multiple use tool and, for example, to a tool that is configured to be used in emergency situations.

BACKGROUND

Tools having multiple implements—such as screw drivers, knives, and pliers—are known. Examples include those distributed by the Leatherman Tool Group, Inc. of Portland, Oreg. These tools are generally in the form of elongated arms which house the various implements, allowing them to be deployed as desired by the user. In addition, generally flat or planar multi-tools are also known, such as the TOOLCARD PRO tool by Lever Gear. These types of multi-tools have a generally planar shape and have various openings and extensions formed therein for use as tools.

SUMMARY

A multi-tool includes a body having a top face and a bottom face. At least one opening extends from the top face to the bottom face. The at least one opening is sized and configured to receive a finger of a user. A perimeter face connects the top face and the bottom face. The perimeter face includes a convex portion spaced from the at least one opening in a first direction. The convex portion is configured to contact a palm of the user. The body also includes two or more tools formed therein.

In another embodiment, a multi-tool includes a first portion and a second portion. The first portion has a top face, a bottom face, a mid-plane between the top face and the bottom face, a first fixed jaw, and a second fixed jaw. The second portion is rotatably coupled to the first portion and is rotatable about a rotation axis that is within a second plane that is orthogonal to the mid-plane. The second portion includes a first movable jaw extending from the second plane in a first direction and a second movable jaw extending from the second plane in a second, opposite direction. In a closed position the first movable jaw is adjacent to the first fixed jaw and the second movable jaw is adjacent to the second fixed jaw. Rotation of the second portion changes a distance between the first fixed jaw and the first movable jaw and also changes a distance between the second fixed jaw and the second movable jaw.

In another embodiment, a multi-tool includes a body having a top face, a bottom face, and a perimeter face connecting the top face and the bottom face. The perimeter face has a first concave portion and a second concave portion spaced from the first concave portion in a first direction. The first concave portion and the second concave portion are each sized and configured to receive a finger of a user. The perimeter face further includes a convex portion that is spaced from the first concave portion in a second direction that is transverse to the first direction. The convex portion is configured to contact a palm of the user. The body further includes two or more tools formed in the body.

BRIEF DESCRIPTION OF THE DRAWINGS

The features and advantages of the embodiments described herein will be more fully disclosed in, or rendered obvious by the following detailed description of the preferred embodiments, which are to be considered together with the accompanying drawings wherein like numbers refer to like parts and further wherein:

FIG. 4B shows a top view of the multi-tool of FIG. 4A with

DETAILED DESCRIPTION

Figure 1A:
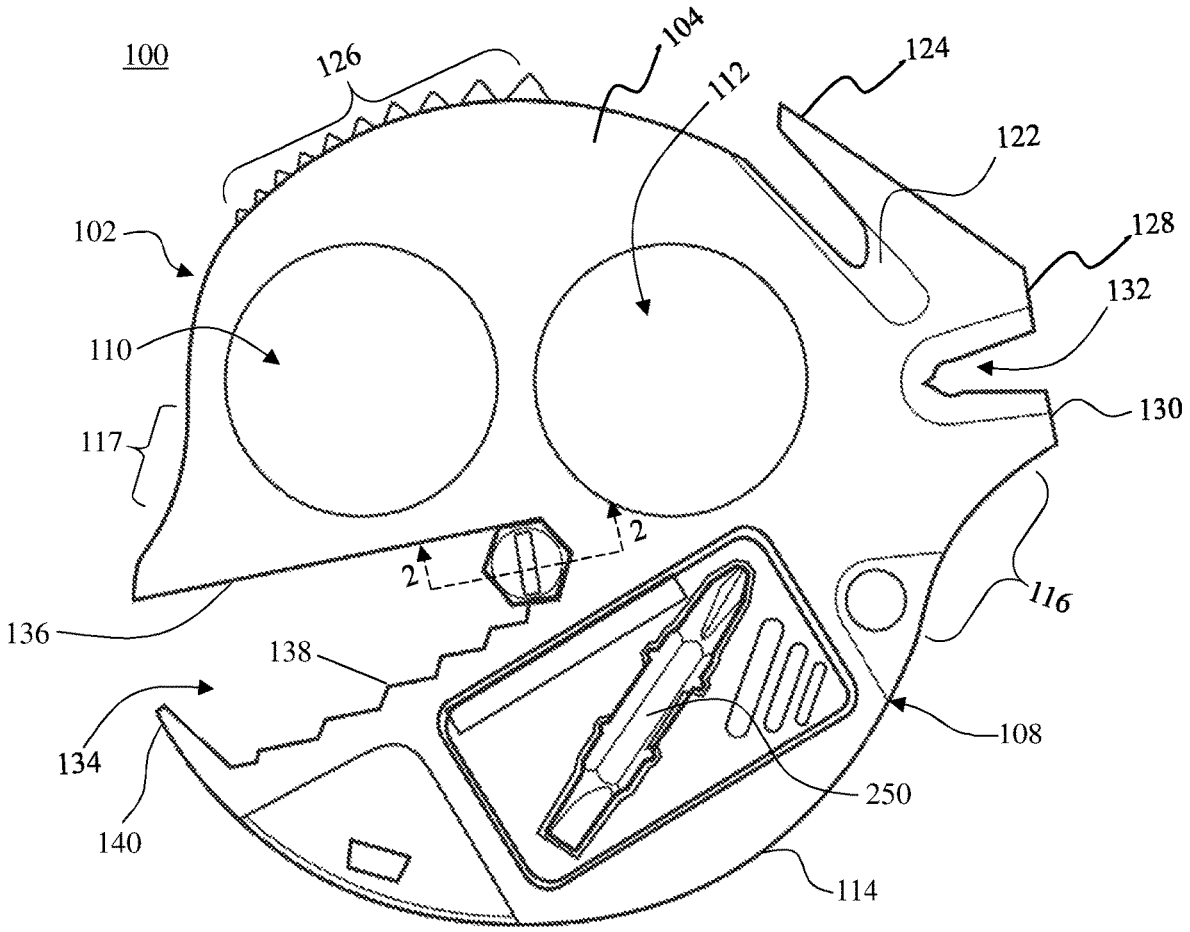
FIG. 1A shows a top view of a multi-tool, according to one embodiment.

The description of the preferred embodiments is intended to be read in connection with the accompanying drawings, which are to be considered part of the entire written description. The drawing figures are not necessarily to scale and certain features may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise. The term "operatively coupled" is such an attachment, coupling, or connection that allows the pertinent structures to operate as intended by virtue of that relationship.

When values are expressed as approximations, by use of the antecedent "about," it will be understood that the particular value forms another embodiment. As used herein, "about X" (where X is a numerical value) preferably refers to ±10% of the recited value, inclusive. For example, the phrase "about 8" preferably refers to a value of 7.2 to 8.8, inclusive; as another example, the phrase "about 8%" preferably (but not always) refers to a value of 7.2% to 8.8%, inclusive. Where present, all ranges are inclusive and combinable. For example, when a range of "1 to 5" is recited, the recited range should be construed as including ranges "1 to 4", "1 to 3", "1-2", "1-2 & 4-5", "1-3 & 5", "2-5", and the like. In addition, when a list of alternatives is positively provided, such listing can be interpreted to mean that any of the alternatives may be excluded, e.g., by a negative limitation in the claims. For example, when a range of "1 to 5" is recited, the recited range may be construed as including situations whereby any of 1, 2, 3, 4, or 5 are negatively excluded; thus, a recitation of "1 to 5" may be construed as "1 and 3-5, but not 2", or simply "wherein 2 is not included."

Various embodiments are described herein. Similar features of the various embodiments are referenced by incrementing alphabetic characters, for example, "110", "110*a*", "110*b*", "110*c*." Each of these features may not be described with reference to each of the depicted embodiments, but one of skill in the art would understand that the features can be similar between the embodiments. In addition, features shown in, or described with reference to, one embodiment can also be provided in other embodiments, whether or not shown or described.

The multi-tools described herein can be used as a personal escape tool (PET) in emergency escape applications as well as in various other applications. The multi-tool enables the operator to insert fingers into a plurality of openings of a planar surface in order to control a variety of tools formed in, or attached to, the multi-tool. The multi-tools described herein provide for ergonomic, compact use in a variety of situations and include various tools configured to perform a variety of functions.

Figure 1B:
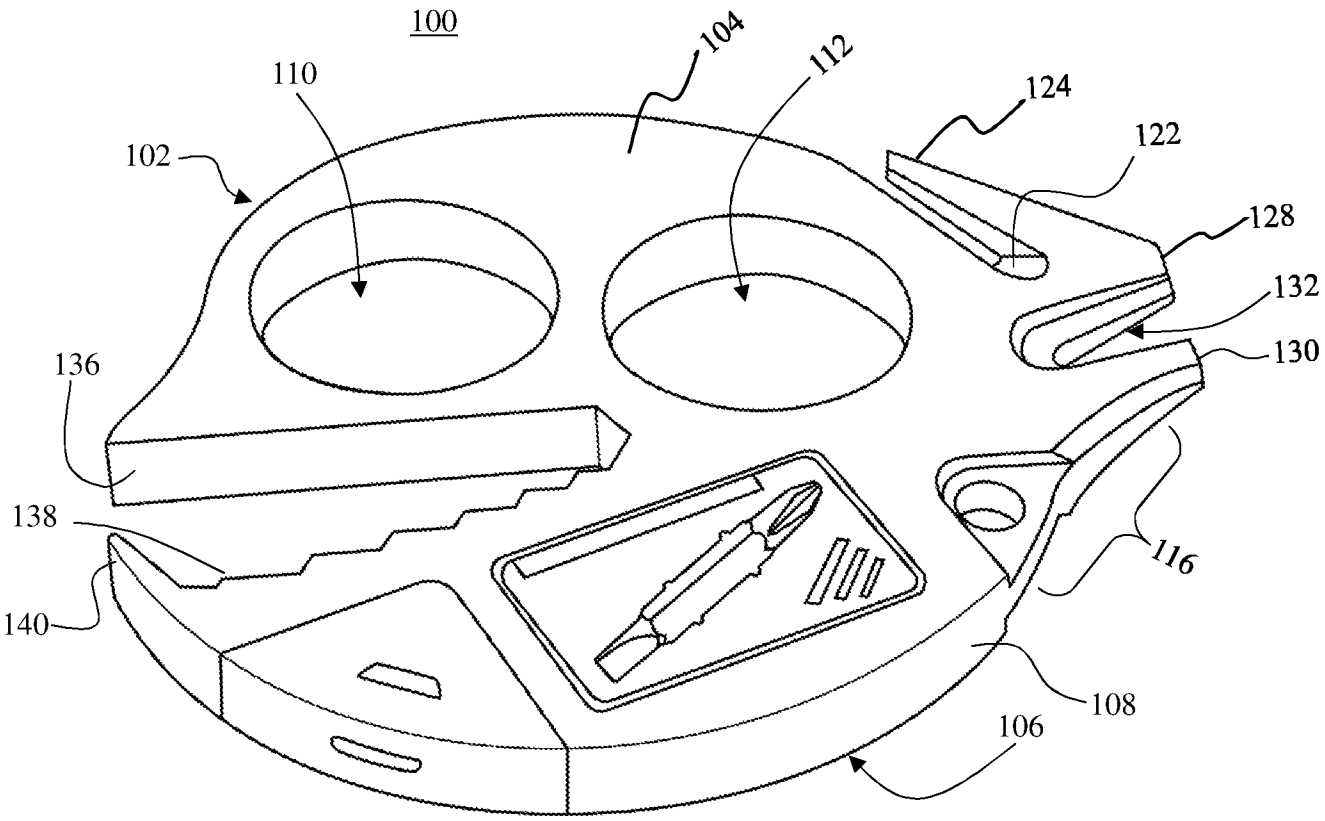
FIG. 1B shows a perspective view of the multi-tool of FIG. 1A.

As shown in FIGS. 1A and 1B, according to a first embodiment, a multi-tool 100 is provided including a body 102 having a top face 104 opposing a bottom face 106. A perimeter face 108 connects the top 104 and bottom 106 faces. The body 102 can be a monolithic body. Alternatively, the top 104 and bottom 106 faces can be portions of separate components that are affixed to one another using a fastener, adhesive, snap-arms, or any other appropriate means. Although a generally circular body 102 is depicted in the figures, any suitable shape may be used.

Figure 3A:
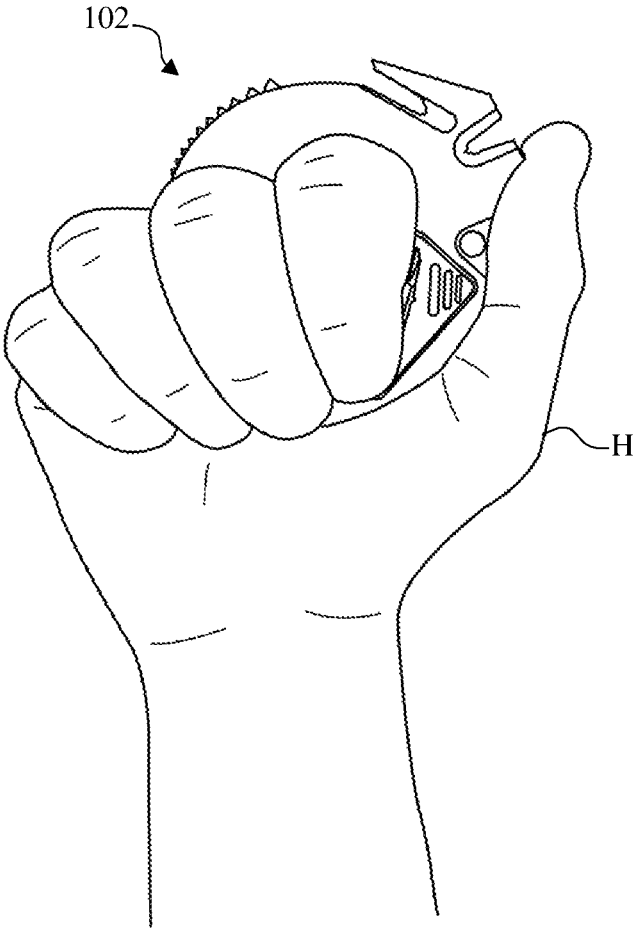
FIG. 3A shows the multi-tool of FIG. 1 in use in a first gripping position.
Figure 3B:
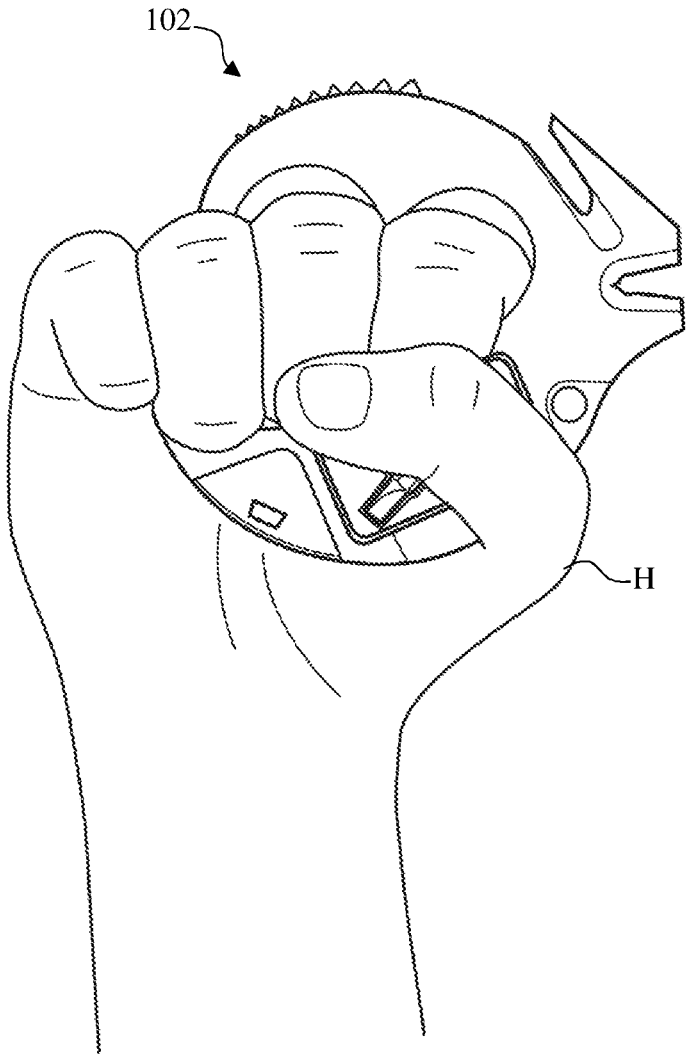
FIG. 3B shows the multi-tool of FIG. 1 in use in a second gripping position.

As shown in FIGS. 3A and 3B, the multi-tool 100 is configured to fit in the palm of a hand "H". Returning to FIG. 1, the body 102 includes a first opening 110 and a second opening 112 configured to receive fingers of the user's hand. The body 102 is designed to be comfortable and ergonomic when resting in the palm of the user's hand. In some embodiments, the perimeter face 108 of the body 102 includes a convex portion 114 spaced from the first 110 and second 112 openings in a first direction. The convex portion 114 is configured to receive and/or contact a portion of the user's palm. The perimeter face 108 of the body 102 also includes a concave portion 116 adjacent to the convex portion 114. The concave portion 116 is configured to receive a thumb of the hand when fingers are inserted into the openings 110, 112 (as shown in FIG. 3A). In some embodiments, the at least two openings 110, 112 are further configured to receive fingers of a gloved hand. In at least one embodiment, the convex portion 114 can be used as a hammer. In such embodiments, the convex portion 114 can include knurls to increase the effectiveness of the hammer. FIG. 3B shows another position in which the multi-tool 100 can be held in which the user's thumb wraps around the convex portion 114.

In one embodiment, the perimeter face 108 also includes a second concave portion 117. The second concave portion 117 is spaced from the first 110 and second 112 openings in a second direction that is transverse to the first direction. The second concave portion 117 is configured to receive additional fingers of the user, such as the ring finger, as shown in FIGS. 3A and 3B. The arrangement of the convex portion 114, the concave portion 116, and the second concave portion 117 provides an ergonomic shape and allows a user to comfortably operate the various implements of the multi-tool 100. The multi-tool 100 can be held comfortably in various positions and orientations, with either side facing the inside of the user's hand.

In various embodiments, the multi-tool 100 is approximately three inches in diameter or between peripheral edges. In another embodiment, the multi-tool 100 is between about two inches and about four inches in diameter or between peripheral edges. In other embodiments, the multi-tool 100 may be of various sizes to accommodate a variety of hand sizes as would be understood by one of ordinary skill in the art.

The body 102 can be constructed of any appropriate material. For example, the body 102 can be constructed from aluminum, steel, stainless steel, titanium, polymer, or any other appropriate material.

According to various embodiments of the present disclosure and as depicted in the figures, the multi-tool 100 is configured to allow an operator to manipulate, while applying force, various tools formed in, or attached to, the body 102. In one embodiment, the tools include features that are essential to vehicular escape.

For example, the multi-tool 100 can include a recessed blade 122 at the perimeter face 108 of the body 102. The blade 122 is configured for cutting the strap of a seatbelt, strap, or other member. In various embodiments, the recessed blade 122 may also be configured to cut string. In other embodiments, the recessed blade 122 may also be configured to act as a box cutter. In one embodiment, the blade 122 is integrally formed with the body 102. In other embodiments, the blade 122 is a separate component that is affixed to the body 102 using fasteners, adhesive, or other means, such as sandwiching the blade between the top face 104 and the bottom face 106. In one embodiment, the body 102 forms a shroud 124 that shields the blade 122 to prevent inadvertent contact and injury.

In some embodiments, body 102 includes a plurality of teeth 126 along the perimeter face 108 and configured to act as a saw blade. The teeth 126 can be integrally formed with the body 102 or, alternatively, can be a portion of an insert or accessory that is affixed or attached to the body 102. When a user grasps the multi-tool 100 with their fingers inserted into the first opening 110 and the second opening 112, force may be applied to saw or cut objects using the plurality of teeth 126.

Figure 1C:
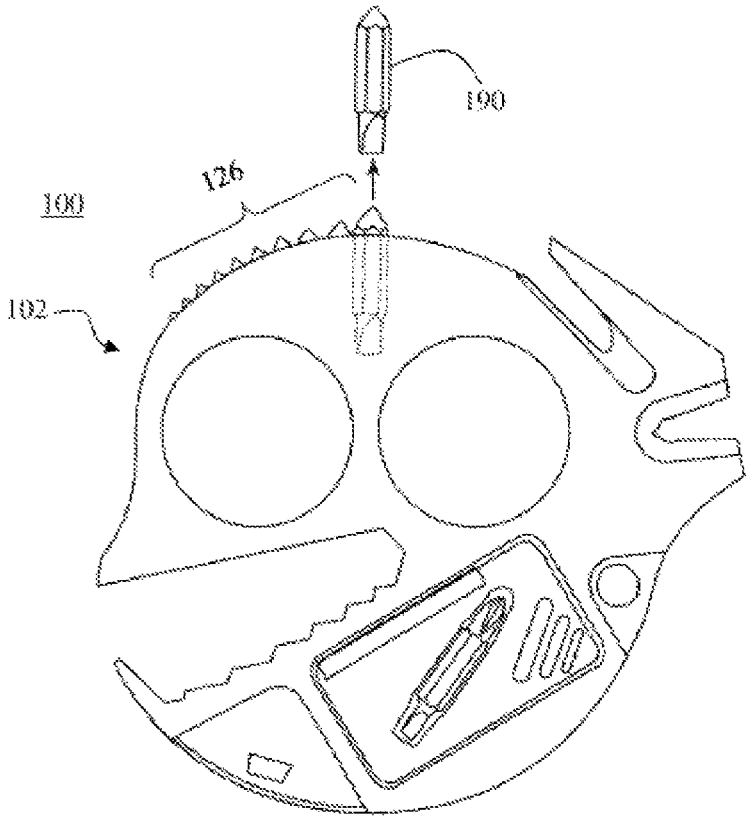
FIG. 1C shows a top view of the multi-tool of FIG. 1A in which a portion of the teeth are formed by a driving bit.

One or more of the teeth 126 can be used as a glass breaker. By grasping the body 102 as shown, for example, in FIGS. 3A or 3B the user can impact glass with the teeth 126. As shown in FIG. 1C, one or more of the teeth 126 can be formed from a driving bit 190. This provides storage for the driving bit 190 while at the same time providing a hardened point to allow for a large amount of force to be applied to the glass. The opposite end of the driving bit (shown disposed within the body 102) can be in the form of any appropriate driving bit, such as, for example, a Phillips driver, a slotted driver, a Torx driver, a hex driver, or any other appropriate shape. In at least one embodiment, the driving bit 190 can be inserted into the body 102 in either orientation, such that in one orientation the driving end of the bit extends from the body and can be used to tighten or loosen a screw.

In some embodiments, the body 102 includes a pry bar 128. The pry bar 128 can include a thin edge that allows the pry bar 128 to be inserted beneath an object. By applying force to the body 102, the user can apply a prying force to the object to move or dislodge the object.

The body 102 can also include a screw driver 130 extending from the perimeter face 108. The pry bar 128 and the screw driver 130 can extend from the perimeter face 108 at an incline, such that the they converge from a greater thickness to a lesser thickness at their operative end. The pry bar 128 and the screw driver 130 can be adjacent to one another and spaced to form a recess 132 configured to engage the head of a nail for nail removal. The nail can be positioned in the recess 132 and a force applied to the body 102 to remove or loosen the nail.

In addition, one or more tools can be positioned interior to the perimeter face 108 of the body 102. For example, a wrench opening 134 configured to impart torsion force on hexagonal head screws extends between the top 104 and bottom 106 faces and extends to the perimeter face 108. In another embodiment, the wrench opening 134 is closed at the perimeter face 108. The wrench opening 134 is formed by an upper jaw 136 and a lower jaw 138. The upper jaw 136 and the lower jaw 138 diverge at an angle such that the distance between the upper jaw 136 and the lower jaw 138 is larger at the perimeter face 108 than near the center of the body 102. In one embodiment, the upper jaw 136 is substantially smooth and the lower jaw 138 includes a plurality of valleys. Each of the plurality of valleys is configured to engage a different size hex head screw. In another embodiment, the upper jaw 136 includes a plurality of valleys and the lower jaw 138 is substantially smooth. In another embodiment, both the upper jaw 136 and the lower jaw 138 include valleys. In some embodiments, the upper jaw 136 and/or lower jaw 138 are textured to grip a screw or bit disposed therein. In other embodiments, separate wrench openings are provided for various size screws, bolts, or nuts. The wrench openings 134 can be used for hex head screws, oxygen tank valves, gas-cut off valves or any other appropriate member.

The body 102 can also include a bottle opener 140 along the perimeter face 108. The bottle opener 140 is configured to engage a bottle cap for opening bottle.

Figure 2:
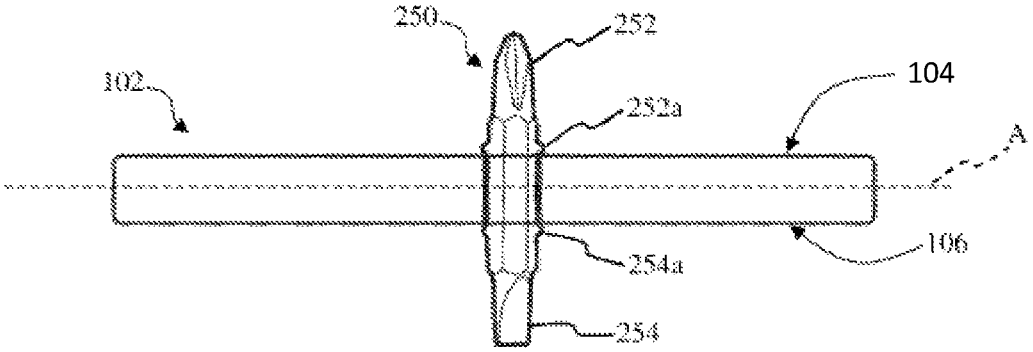
FIG. 2 shows a partial cross-sectional view of a driving bit disposed in a cavity of the multi-tool of FIG. 1.

As shown in FIGS. 1A and 2, the tool 10 can also include a driving bit 250 having a first driving end 252 and a second driving end 254. The first driving end 252 includes a first shoulder 252*a* and the second driving end 254 includes a second shoulder 254*a*. As shown best in FIG. 2, the driving bit 250 is configured to be received in a cavity of the body, for example the wrench opening 134, such that the first shoulder 252*a* contacts the top face 104 and the second shoulder 254*a* contacts the bottom face 106. As a result, the first driving end 252 extends away from the mid-plane 'A' of the body 102 in a first direction and the second driving end 254 extends away from the mid-plane in an opposite second direction.

Engagement of the driving bit 250 with the multi-tool 100 allows the driving bit 250 to be used to tighten or loosen screws. Additionally, because both the first driving end 252 and the second driving end 254 extend from the body 102, the body 102 can be turned over to quickly switch from using the first driving end 252 to the second driving end 254. For example, the first driving end 252 can be in the form of a Philips-head driver and the second driving end 254 can be in the form of a slotted-head driver. As a result, the driving bit 250 can be used to tighten and loosen multiple types of screws quickly.

In some embodiments (not shown), the multi-tool 100 includes other tools including a high torque socket (driver slot), carbineer clip, LED light, and/or a compass. The multi-tool 100 can also include various other tools as would be understood by one of ordinary skill in the art.

Figure 4A:
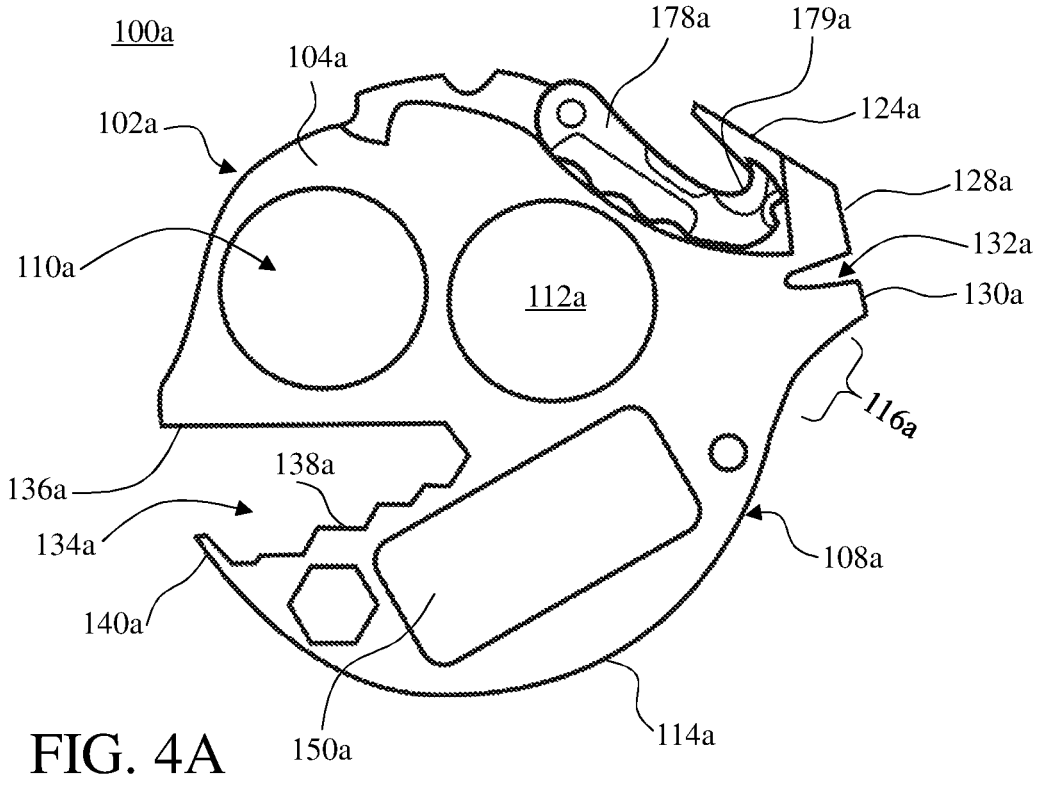
FIG. 4A shows a top view of a multi-tool, according to another embodiment.
Figure 4B:
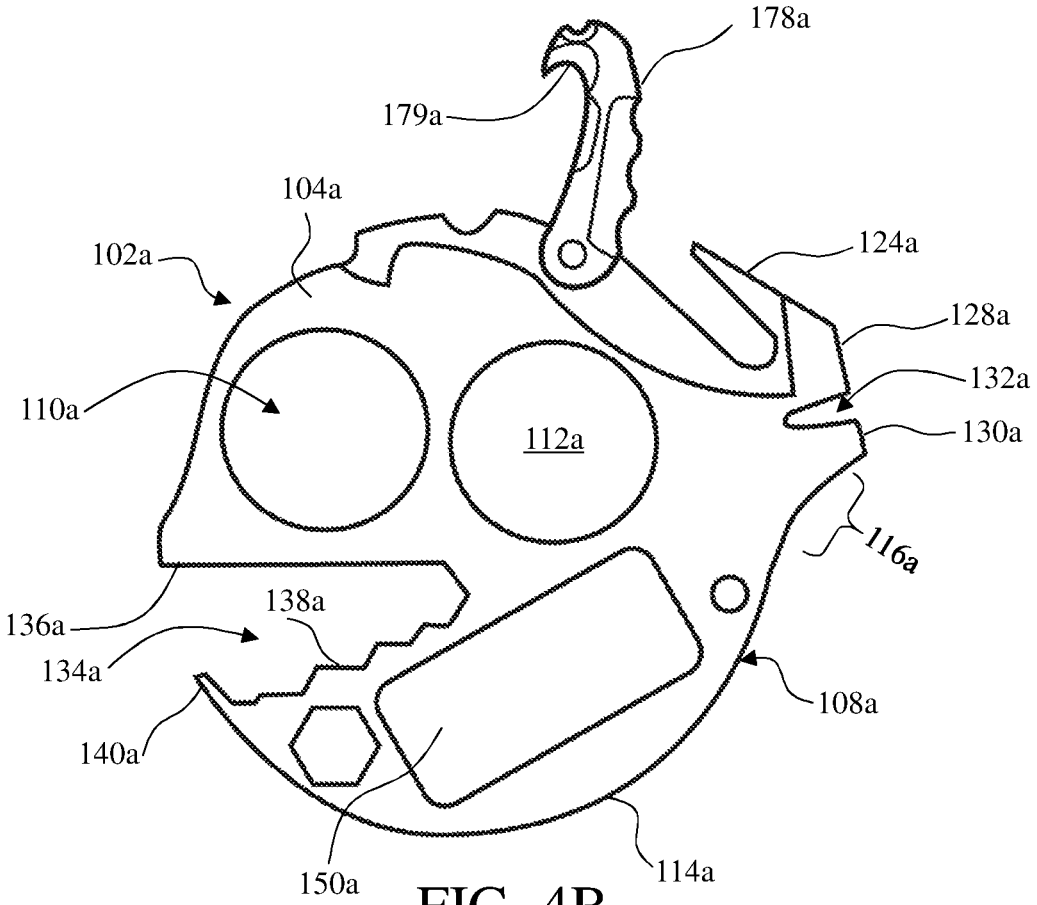

In another embodiment, shown in FIGS. 4A and 4B, the multi-tool 100*a* can include a deployable knife 178*a*. In the collapsed position, the blade 179*a* of the deployable knife 178*a* is disposed within the shroud 124*a* of the body 102*a*. As a result, the blade 179*a* can be used to cut a seat belt, strap, or other member. In the deployed position, as shown in FIG. 4B, the deployable knife 178*a* can be used as a traditional knife. The knife 178*a* is pivotable about an axis that is substantially perpendicular to the mid-plane 'A'.

In addition, the multi-tool 100*a* can include a bit holder 150*a*. The bit holder 150*a* can be fixedly or removably secured to the body 102*a*. For example, the body 102*a* can include a recess into which the bit holder 150*a* can snap into. The bit holder 150*a* can be configured to retain a single ended bit (as shown in FIGS. 4A and 4B) or a double-ended bit (as shown in FIG. 1A).

Figure 5A:
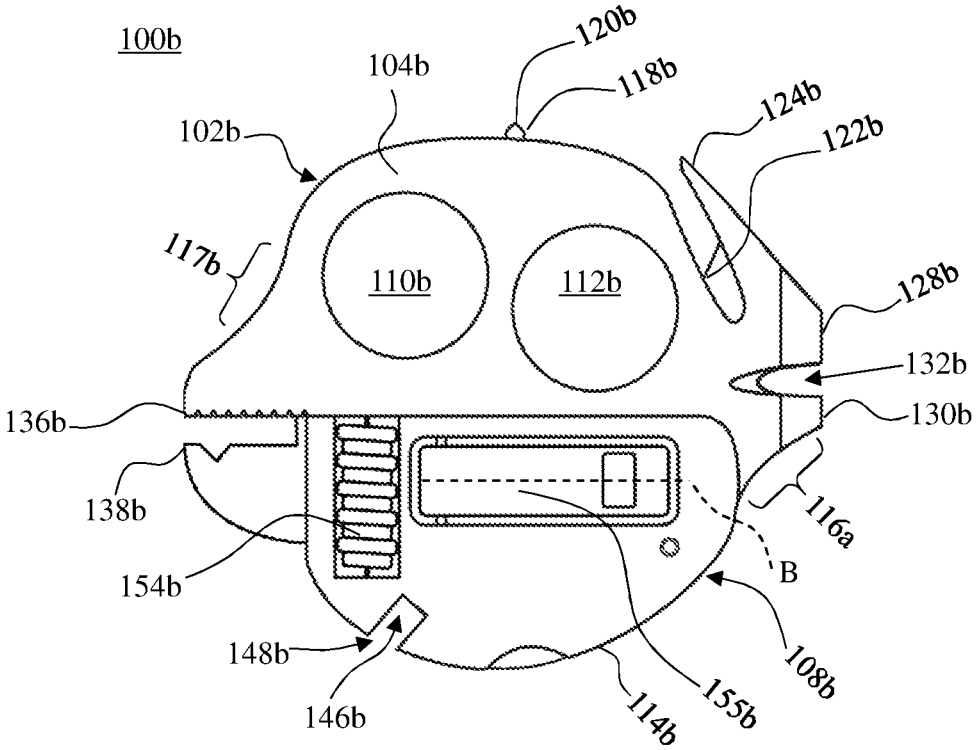
FIG. 5A shows a top view of a multi-tool, according to another embodiment.
Figure 5B:
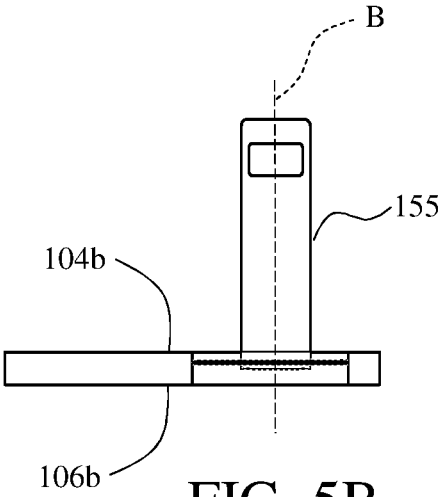
FIG. 5B shows a whistle of the multi-tool of FIG. 5A in an extended configuration.
Figure 5C:
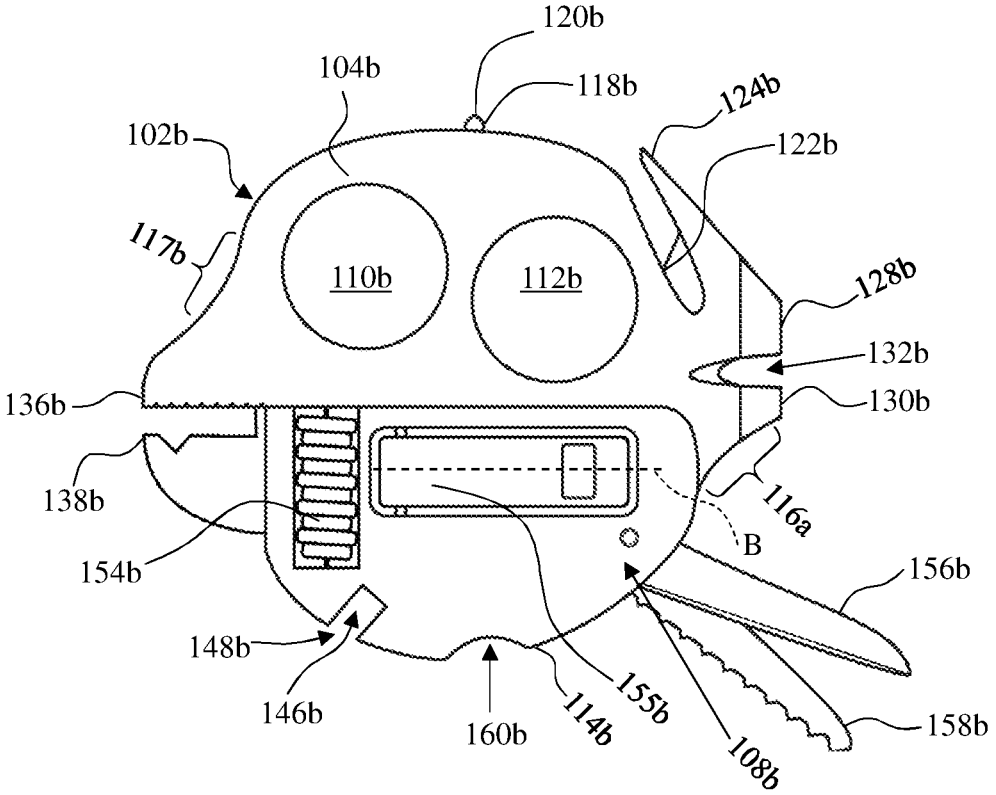
FIG. 5C shows the multi-tool of FIG. 5A with a knife and a saw in an extended configuration.

In another embodiment, shown in FIGS. 5A-5C, a multi-tool 100*b* includes a movable lower jaw 138*b*. The movable lower jaw 138*b* is movable in a plane that is parallel to the midplane of the body 102*b*. The movable lower jaw 138*b* is configured such that the distance between the upper jaw 136*b* and the lower jaw 138*b* can be varied. The lower jaw 138*b* includes a valley configured to engage the head of a hex head screw. Translation of the lower jaw 138*b* allows the multi-tool 100*b* to accommodate a variety of sizes of hex head screws. While FIGS. 5A-5C illustrate the lower jaw 138*b* being the movable jaw, it is contemplated that either the upper jaw 136*b* or the lower jaw 138*b* may be movable. In addition, in one embodiment, both the upper jaw 136*b* and the lower jaw 138*b* are movable.

Any appropriate design can be used to allow for the translation of the lower jaw 138*b*. For example, in the embodiment illustrated in FIG. 5A, the lower jaw 138*b* is mounted to a lead screw 154*b*. Rotation of the lead screw 154*b* causes translation of the lower jaw 138*b*.

In addition, the body 102*b* can include a protrusion 118*b* extending from the perimeter face 108*b*. The protrusion 118*b* includes a pointed tip 120*b* configured to be used to break glass. In one embodiment, the protrusion 118*b* is assembled or joined to the body 102*b* using adhesive, screws, or any other appropriate means. In one embodiment, a portion of the protrusion 118*b* is disposed between one or more portions of the body 102*b* (e.g., between the top 104*b* and bottom 106*b* faces). In another embodiment, the protrusion 118*b* is integrally formed with the body 102*b*. The protrusion 118*b* can have any appropriate geometry. For example, the protrusion 118*b* can be conical, frustoconical, pyramidal, or any other appropriate shape. In various embodiments, the protrusion 118*b* and the plurality of teeth 126 (shown in FIG. 1) are provided on the same body and are spaced along the perimeter face such that the plurality of teeth 126 may engage an object in a saw-like motion without interference from the protrusion 118*b*.

The protrusion 118*b* can be constructed of any appropriate material. For example, the protrusion 118*b* can be constructed from aluminum, steel, stainless steel, titanium, polymer, or any other appropriate material.

In addition, in various embodiments, the first opening 110*b* and the second opening 112*b* are configured to receive fingers of a hand such that the multi-tool 100*b* may be used to provide impact force for the protrusion 118*b* to break a pane of glass.

The body 102*b* also includes a bit driver recess 146*b*. The bit driver recess 146*b* is a generally rectangular recess extending between the top face 104*b* and the bottom face 106*b* and includes an open end 148*b* at the perimeter face 108*b*. The bit driver recess 146*b* is configured to receive a bit therein such as a screw driving bit. The bit driver recess 146*b* is configured to receive the proximal end of the bit such that the distal, or operative, end of the bit extends from the perimeter face 108*b*. This allows the multi-tool 100*b* to interface with a screw having any head type, including a Phillips head, a slotted head, a Torx head, a hex head or any other appropriate type.

As shown best in FIG. 5B, the multi-tool 100*b* also includes a deployable whistle 155*b*. The whistle 155*b* is pivotably mounted to the body 102*b* such that the whistle 155*b* can be in a collapsed configuration, shown in FIG. 5A, or an extended configuration, shown in FIG. 5B. The whistle 155*b* can be used to signal for emergency assistance. In the collapsed configuration, the longitudinal axis 'B' of the whistle 155*b* is substantially parallel to the mid-plane 'A' (shown in FIG. 2). of the body 102*b*. In the extended configuration, the longitudinal axis 'B' of the whistle 155*b* is substantially perpendicular to the mid-plane of the body 102*b*.

As shown in FIG. 5C, the multi-tool 100*b* can also include a knife 156*b* and a saw 158*b*. The knife 156*b* and saw 158*b* can each be pivotably mounted to the body 102*b* such that they can be in a collapsed configuration, shown in FIG. 5A, or an extended configuration, shown in FIG. 5C. In the collapsed configuration, the respective blades of the knife 156*b* and saw 158*b* are housed within the body 102*b* to prevent inadvertent contact. The knife 156*b* and saw 158*b* are mounted such that they can be individually deployed to the extended configuration. The knife 156*b* and saw 158*b* pivot about an axis that extends substantially perpendicular to the mid-plane 'A' of the body 102*b*. The body 102*b* includes a finger recess 160*b* to allow a user to more easily engage and deploy the knife 156*b* or saw 158*b*.

Figure 6A:
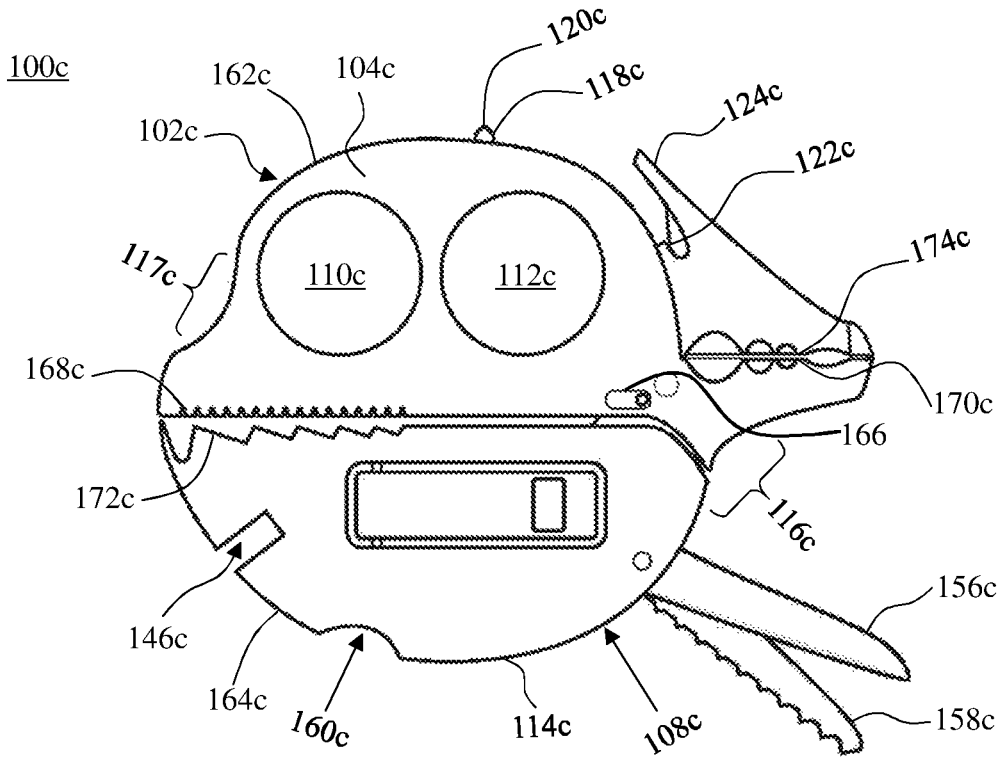
FIG. 6A shows a top view of a multi-tool, according to another embodiment.
Figure 6B:
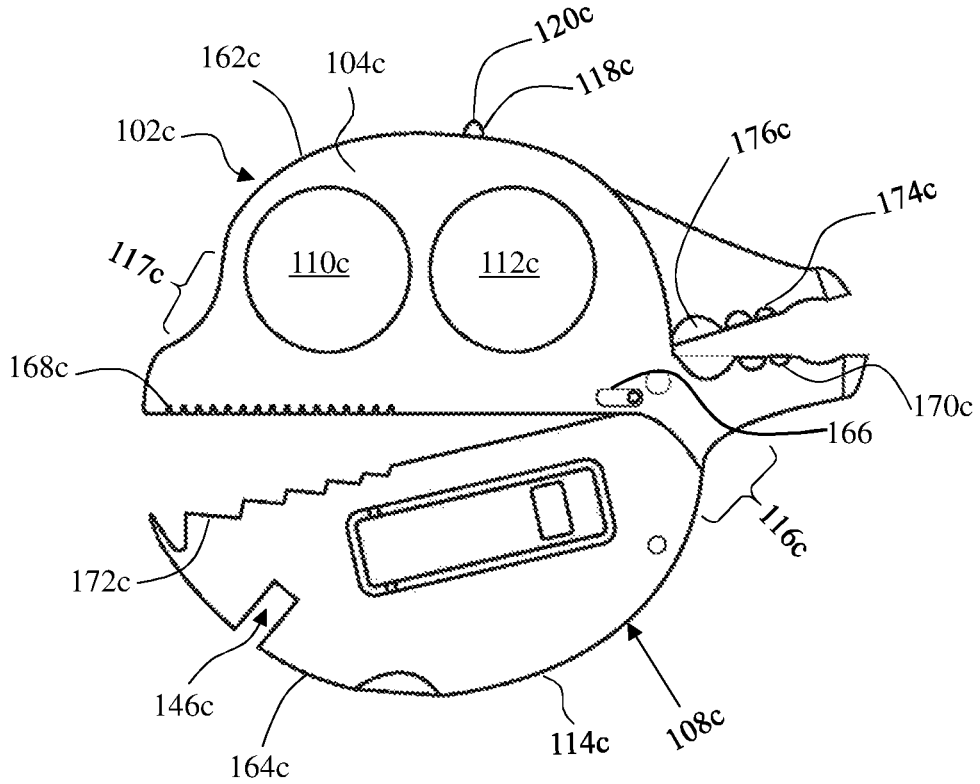
FIG. 6B shows the multi-tool of FIG. 6B with a jaw of the multi-tool in an open configuration.

As shown in FIGS. 6A and 6B, in one embodiment, the body 102*c* includes a first portion 162*c* and a second portion 164*c* that is rotatably mounted to the first portion 162*c*. The first portion 162*c* includes a top face 104*c* and a bottom face 106*c*. The first portion 162*c* also includes a first fixed jaw 168*c* and a second fixed jaw 170*c*. The second portion 164*c* is rotatably mounted to the first portion 162*c* about a rotation axis that is within a second plane that is orthogonal to the mid-plane 'A'. The second portion 164*c* includes a first movable jaw 172*c* extending from the second plane in a first direction and a second movable jaw 174*c* extending from the second plane in a second, opposite direction. In a closed configuration, shown in FIG. 6A, the first movable jaw 172*c* is adjacent to the first fixed jaw 168*c* and the second movable jaw 174*c* is adjacent to the second fixed jaw 170*c*. The rotation axis is positioned between the first movable jaw 172*c* and the second movable jaw 174*c* such that rotating the second portion 164*c* about the rotation axis changes a distance between the first fixed jaw 168*c* and the first movable jaw 172*c* and also changes a distance between the second fixed jaw 170*c* and the second movable jaw 174*c*. FIG. 6A shows the first portion 162*c* and the second portion 164*c* in a closed configuration and FIG. 6B shows the first portion 162*c* and the second portion 164*c* in an open configuration. The multi-tool 100*c* can include a locking mechanism 166*c* to lock the first portion 162*c* and second portion 164*c* in a desired position.

In one embodiment, the first fixed jaw 168*c* and the first movable jaw 172*c* are configured to operate as a wrench. One or both of the first fixed jaw 168*c* and/or the first movable jaw 172*c* can include ridges configured to receive and engage a hex head screw, bolt, or nut. The plurality of ridges may allow a variety of sizes to be accommodated by the multi-tool 100*c*. The locking mechanism 166*c* can be used to lock the second portion 164*c* in position to allow the multi-tool 100*c* to be used to tighten or loosen a screw, bolt, or nut. In addition, the second fixed jaw 170*c* and the second movable jaw 174*c* can form a wire cutter or stripper. The wire cutter or stripper includes one or more stripping apertures 176*c* for stripping the insulating sleeve from a variety of diameters of wire.

Alternatively, the second fixed jaw 170*c* and the second movable jaw 174*c* can form pliers. In such an embodiment, the second fixed jaw 170*c* and/or the second movable jaw 174*c* can have flat or textured faces configured to grasp objects.

The recessed blade 122*c* can be engaged with the second portion 164*c*. In such an embodiment, the shroud 124*c* can be formed on the upper portion of the second movable jaw 174*c*. In addition, The shroud 124*c* can also be configured to be used as a letter opener.

Figure 7:
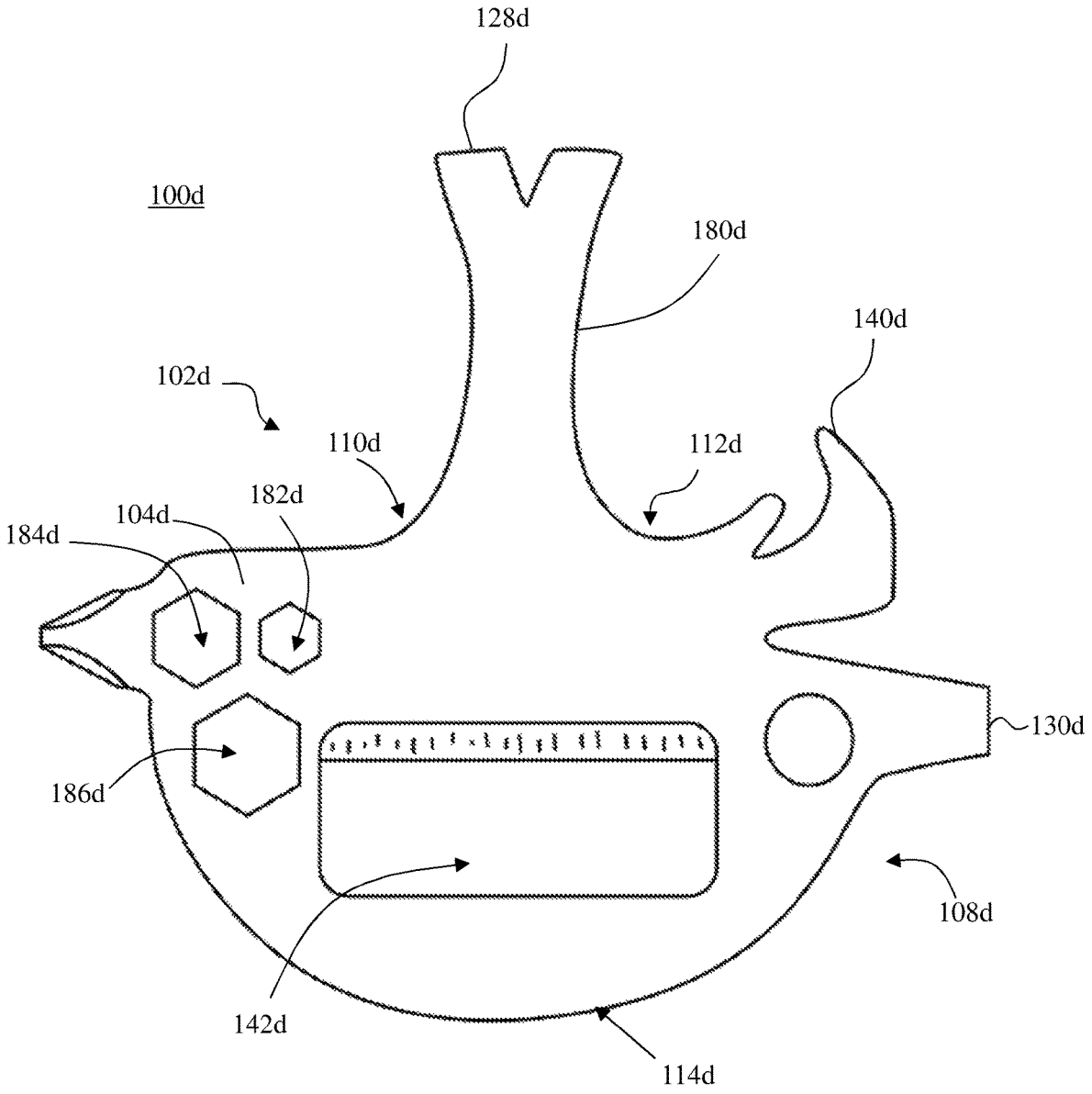
FIG. 7 shows a top view of a multi-tool, according to another embodiment.

In another embodiment, shown in FIG. 7, the body 102*d* includes first 110*d* and second 112*d* openings that are not closed at their upper portions. As such, each of the openings are formed from concave portions in the perimeter face 108*d*. The second concave portion 112*d* is spaced from the first concave portion 110*d* in a first direction. The convex portion 114*d* is spaced from the first concave portion 112*d* in a second direction that is transverse to the first direction. In addition, the body 102*d* further comprises an extension 180*d* positioned between the first concave portion 110*d* and the second concave portion 112*d*. The extension 180*d* incudes one or more tools formed therein. For example, a pry bar 128*d* can be formed at the end of the extension 180*d*. Also, as shown in FIG. 7, multiple hex sized openings 182*d*, 184*d*, 186*d* can be formed in the body 102*d* and configured for engagement with a variety of sizes of hex head screws.

In addition, in the embodiment shown in FIG. 7, a gas valve wrench 142*d* is formed in the body 102*d*. The gas valve wrench 142*d* is a generally rectangular shaped recess or aperture formed in the body 102*d* that is sized to engage a shut-off valve of a gas supply line. This can be used in case of emergencies to terminate flow of gas into a home or building.

Figure 8A:
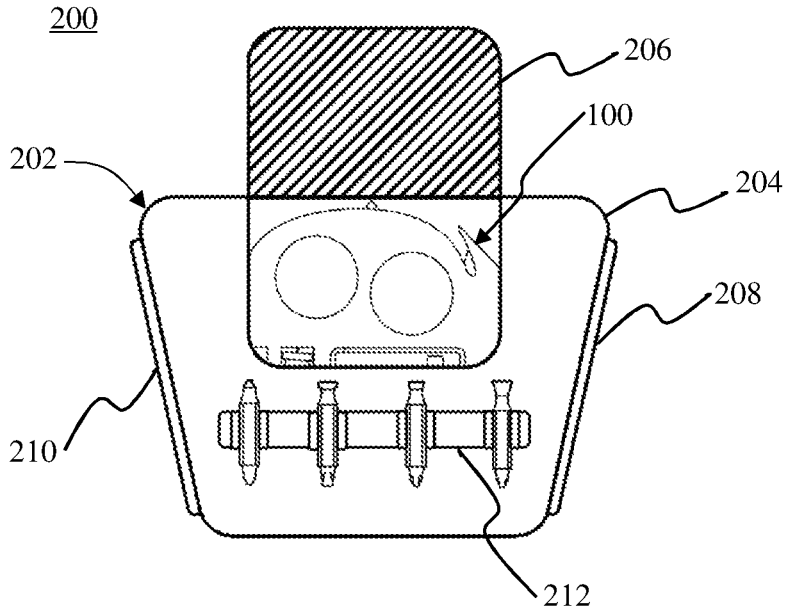
FIG. 8A shows a multi-tool and a storage sheath, according to one embodiment.
Figure 8B:
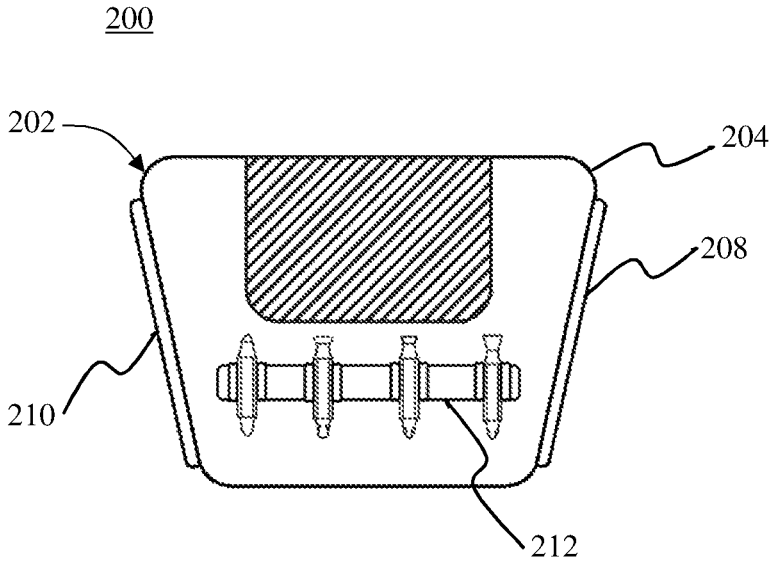
FIG. 8B shows the multi-tool and storage sheath of FIG. 8A with the sheath closed.

In another aspect, a tool system 200 is provided having a multi-tool 100 according to any embodiment described above and a sheath 202, as shown in FIGS. 8A and 8B. The sheath 202 includes a case 204 configured to receive and enclose the multi-tool 100. The case 204 includes a lid 206 that can be closed over the multi-tool 100 to retain it within the case 204. The sheath 202 can also include a magnesium rod 208 along a side of the case 204. The magnesium rod

208 is configured to be used as a firestarter. The sheath 202 can also include a ferro rod 210 attached thereto. The ferro rod 210 is constructed from ferrocerium and can also be used as a firestarter. In another embodiment, the sheath 202 has a single rod attached thereto. The single rod can be constructed of magnesium, ferrocerium, or any other material appropriate for use as a firestarter. The magnesium rod 208 and ferro rod 210 can be permanently affixed to the case 204 or can be removably attached. The sheath 202 can also include a bit holder 212 affixed thereto. The bit holder 212 can hold any number of bits. For example, in one embodiment, the bit holder 212 is configured to hold four bits. The bits can be in any appropriate form, such as, for example, a hex wrench, a Phillips driver, a slotted driver, or a Torx driver. In addition, an extender or adapter can be used to allow the bits to reach hard to reach screws such as recessed screws.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention. All patents and published patent applications identified herein are incorporated herein by reference in their entireties.

What is claimed is:

1. A multi-tool comprising:

a generally circular body having:

a top face;

a bottom face;

at least one opening extending from the top face to the bottom face, the at least one opening sized and configured to receive a finger of a user;

an exterior perimeter face connecting the top face and the bottom face, the perimeter face including a convex portion spaced from the at least one opening in a first direction, the convex portion configured to contact a palm of the user;

wherein the perimeter face further includes a first concave portion, the first concave portion extending from the top face to the bottom face and adjacent to the convex portion, the first concave portion configured to receive a thumb of the user when the finger is received in the at least one opening;

wherein the perimeter face further includes a second concave portion disposed on an opposing side of the body from the first concave portion; and two or more tools formed in the body; and a driving bit having a first driving end and a second driving end, the first driving end including a first shoulder and the second driving end including a second shoulder, the driving bit configured to be received in a cavity of the body such that the first shoulder contacts the top face and the second shoulder contacts the bottom face such that the first driving end extends away from a mid-plane defined between the top face and the bottom face of the body in a first direction and the second driving end extends away from the mid-plane in an opposite second direction.

2. The multi-tool of claim 1, wherein the body includes two openings, each sized and configured to receive a finger.

3. The multi-tool of claim 1, wherein the second concave portion is spaced from the at least one opening in a second direction that is transverse to the first direction.

4. The multi-tool of claim 3, wherein the first and second concave portions are spaced from one another across a mid-point of the body.

5. The multi-tool of claim 3, wherein the second concave portion is configured to receive a second finger of the user.

6. The multi-tool of claim 1, wherein the two or more tools include a protrusion with a pointed tip configured to be used to break glass, the protrusion extending from the perimeter face.

7. The multi-tool of claim 6, wherein the point tip comprises a second driving bit.

8. The multi-tool of claim 1, wherein the two or more tools include a cutting blade configured for cutting a seatbelt.

9. The multi-tool of claim 8, wherein the blade is shrouded.

10. The multi-tool of claim 1, wherein the body includes a cavity extending from the top face to the bottom face and open at the perimeter face, the cavity being substantially rectangular and configured to receive a proximal end of a driving bit such that a distal end of the driving bit extends from the perimeter face.

11. The multi-tool of claim 1, further comprising a sheath, the sheath comprising:

a case defining a pocket configured to receive the multi-tool; and a rod affixed to the case and configured to be used as a firestarter.

12. The multi-tool of claim 1, wherein the first concave portion is configured to be operably engaged by a pad of the thumb of the user when the at least one opening is in receipt of the finger of the user.

13. The multi-tool of claim 1, wherein the at least one opening consists of two openings.

14. The multi-tool of claim 13, wherein the two openings are disposed between the first and second concave portions.

15. The multi-tool of claim 1, wherein one of the two or more tools comprises an extension extending out from the body, the extension forming one side of an elongated, open-ended cavity including a blade contained therein, an inward, opposing side of the open-ended cavity being formed by another portion of the body.

16. The multi-tool of claim 15, wherein the extension further forms a pry bar that converges from a greater thickness nearer a center of the body to a lesser thickness at its operative end.

17. The multi-tool of claim 1, wherein one of the two or more tools comprises a wrench.

18. A multi-tool comprising:

a generally circular body having:

a top face;

a bottom face;

at least one opening extending from the top face to the bottom face, the at least one opening sized and configured to receive a finger of a user;

a perimeter face connecting the top face and the bottom face, the perimeter face including a convex portion spaced from the at least one opening in a first direction, the convex portion configured to contact a palm of the user; and two or more tools formed in the body the multi-tool further comprising a driving bit having a first driving end and a second driving end, the first driving end including a first shoulder and the second driving end including a second shoulder, the driving bit configured to be received in a cavity of the body such that the first shoulder contacts the top face and the second shoulder contacts the bottom face such that the first driving end extends away from a mid-plane defined between the top face and the bottom face of the body in a first direction and the second driving end extends away from the mid-plane in an opposite second direction wherein the driving bit is configured such that the first shoulder operably engages the top face at the same time that the second shoulder operably engages the bottom face when the driving bit is received in the cavity.

* * * * *